US011535914B2

(12) United States Patent
Watanabe et al.

(10) Patent No.: US 11,535,914 B2
(45) Date of Patent: Dec. 27, 2022

(54) DUPLEX STAINLESS STEEL HAVING SUPERIOR LOW TEMPERATURE TOUGHNESS

(71) Applicant: Nippon Yakin Kogyo Co., Ltd., Tokyo (JP)

(72) Inventors: Takayuki Watanabe, Kawasaki (JP); Fugao Wei, Kawasaki (JP)

(73) Assignee: NIPPON YAKIN KOGYO CO., LTD., Tokyo (JP)

( * ) Notice: Subject to any disclaimer, the term of this patent is extended or adjusted under 35 U.S.C. 154(b) by 52 days.

(21) Appl. No.: 16/453,557

(22) Filed: Jun. 26, 2019

(65) Prior Publication Data

US 2020/0048748 A1 Feb. 13, 2020

(30) Foreign Application Priority Data

Aug. 8, 2018 (JP) ..... JP2018-149215

(51) Int. Cl.
*C22C 38/54* (2006.01)
*C22C 38/44* (2006.01)
(Continued)

(52) U.S. Cl.
CPC ..... *C22C 38/54* (2013.01); *C21D 6/004* (2013.01); *C21D 6/005* (2013.01); *C21D 6/008* (2013.01);
(Continued)

(58) Field of Classification Search
CPC ..... C22C 38/54; C22C 38/001; C22C 38/002; C22C 38/02; C22C 38/04; C22C 38/06;
(Continued)

(56) References Cited

U.S. PATENT DOCUMENTS 11,066,719 B2 7/2021 Motoya et al.
2017/0335422 A1 11/2017 Sasaki et al.
(Continued)

FOREIGN PATENT DOCUMENTS

CN 104313309 A * 1/2015
CN 106834965 A * 6/2017
(Continued)

OTHER PUBLICATIONS

Mar. 12, 2020 Office Action issued in Chinese Patent Application No. 201910729200.3.
(Continued)

*Primary Examiner* — Anthony M Liang
(74) *Attorney, Agent, or Firm* — Oliff PLC

(57) ABSTRACT

A duplex stainless steel has reduced precipitation risks of Al nitride and Cr nitride which are undesirable precipitates, and has superior low temperature toughness. The duplex stainless steel has in mass %, indicated as "%", C: 0.001 to 0.030%, Si: 0.05 to 0.5%, S: not more than 0.002%, Ni: 6 to 7.5%, Cr: 23 to 26%, Mo: 2 to 4.0%, N: 0.20 to 0.40%, Al: 0.005 to 0.03%, Mn: 0.05 to 0.3%, B: 0.0001 to 0.0050% and Fe, and the remainder being inevitable impurities. The
(Continued)

duplex stainless steel has an impact value of not less than 87.5 J/cm$^2$ at −46±2° C. as defined in Japanese Industrial Standards Z2242.

16 Claims, 1 Drawing Sheet

(51) Int. Cl.

| | |
|---|---|
| ***C22C 38/42*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***C21D 9/46*** | (2006.01) |
| ***C21D 8/02*** | (2006.01) |
| ***C21D 6/00*** | (2006.01) |

(52) U.S. Cl.
CPC ..... *C21D 8/0205* (2013.01); *C21D 8/0226* (2013.01); *C21D 8/0263* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C21D 2211/001* (2013.01); *C21D 2211/005* (2013.01)

(58) Field of Classification Search
CPC ..... C22C 38/42; C22C 38/44; C21D 6/004; C21D 6/005; C21D 6/008; C21D 8/0205; C21D 8/0226; C21D 8/0263; C21D 9/46; C21D 2211/001; C21D 2211/005
See application file for complete search history.

(56) References Cited

U.S. PATENT DOCUMENTS

| | | | | |
|---|---|---|---|---|
| 2019/0003023 | A1* | 1/2019 | Goodwin | C21D 1/18 |
| 2019/0292619 | A1* | 9/2019 | Motoya | C21D 8/105 |

FOREIGN PATENT DOCUMENTS

| | | | | |
|---|---|---|---|---|
| CN | 106834965 | A | | 6/2017 |
| JP | 2012-140689 | A | | 7/2012 |
| JP | 2014-189825 | A | | 10/2014 |
| JP | 2014189825 | A | * | 10/2014 |
| JP | 6008062 | B1 | | 10/2016 |
| JP | 6303851 | B2 | | 4/2018 |
| WO | 2017/208946 | A1 | | 12/2017 |

OTHER PUBLICATIONS

Jul. 15, 2021 Preliminary Search Report issued in French Application 19 08362.

* cited by examiner

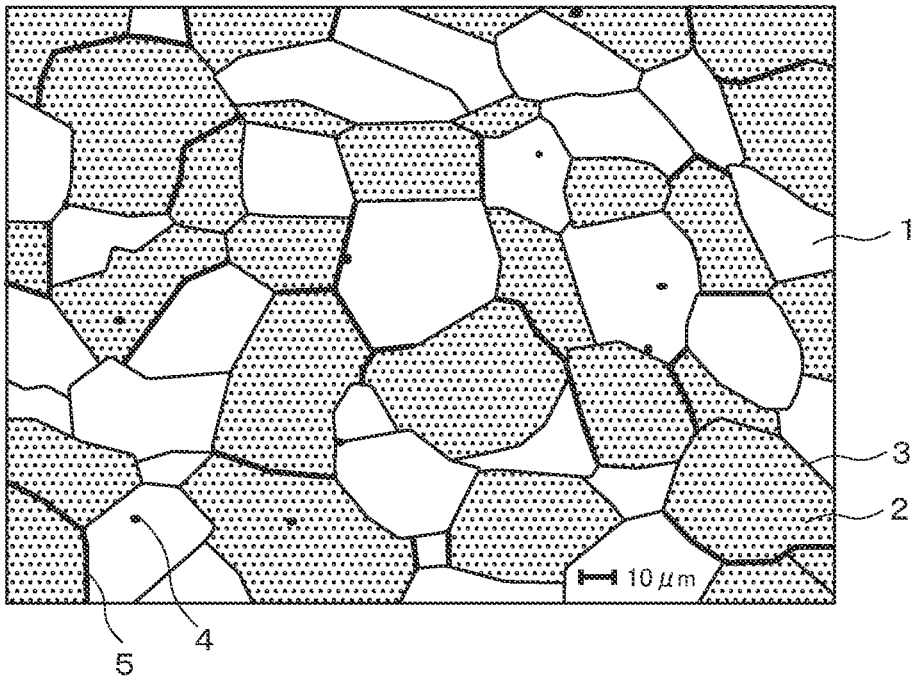
1
3
2
10 μm
4
5

DUPLEX STAINLESS STEEL HAVING SUPERIOR LOW TEMPERATURE TOUGHNESS

TECHNICAL FIELD

The present invention relates to highly corrosion-resistant duplex stainless steel having superior toughness at low temperatures, and in particular, relates to highly corrosion-resistant duplex stainless steel in which Al, N, Cr, Ni, Mo, and Mn are controlled within appropriate ranges.

BACKGROUND ART

A duplex stainless steel is steel that contains iron as a base and also contains Cr, Mo, Ni, and N. Features of this alloy are superior pitting resistance in chloride environments, such as, in particular, marine environments, and strength per unit weight is superior to those of an austenite stainless steel and a ferrite stainless steel. Therefore, necessary strength can be imparted even at thin parts, and thus, weight and size of a product can be easily reduced. Furthermore, since Ni content in a duplex stainless steel is not more than about 8%, which is a relatively low concentration, the alloy can be produced economically at a relatively low cost. In addition, since welding characteristics are also superior, it is recently widely used as a raw material for environments in which high corrosion resistance is required, such as for structures in marine environments, oil well related structures, heat exchangers for a seawater desalination units, and umbilical tubes for oil wells.

When used for an oil well at a sea bottom, in a case in which a unit is provided at a high-latitude such as in the far north, temperatures in the environment around the material are often below freezing Therefore, high toughness is required at very low temperatures.

However, since a duplex stainless steel has poorer phase stability than that of a general austenite stainless steel, hard and brittle nitrides mainly containing Cr, Al and N are easily deposited. In a case in which the nitrides represented by these AlN or $Cr_2N$ are deposited, toughness of the material is decreased, particularly at low temperatures. Furthermore, since Cr, Mo and N contributing to corrosion resistance are in low abundance around the nitrides, corrosion resistance of the alloy is decreased. These characteristics are more remarkable as Al and N increase and as contents of Cr, Mo or the like, which are elements added to improve corrosion resistance, increase.

These nitrides are deposited in a shorter time than the σ phase, which is well known as a harmful intermetallic compound in duplex stainless steel. In particular in a central part of a thick material and in a structure after welding at which water cooling is difficult, there may be a case in which these nitrides are difficult to avoid even at a rapid cooling rate that is almost the same as water cooling.

Therefore, until now, alloy components and methods to obtain low temperature toughness by changing heat treatment conditions and cooling conditions and controlling structure have been variously proposed.

For example, in Patent Document 1, a method for production of seamless steel tube from duplex stainless steel is disclosed, in which stress is accumulated in a ferrite phase by performing hot processing in a temperature range of −300 to +100° C. from a ferrite single phase temperature, structure refinement is performed by cooling an outer surface thereof at a cooling rate of not less than 1.0° C./sec until a temperature range that deposits austenite, and holding the temperature, and appropriate heat treatment for forming a solid-solution or a heat treatment for quenching and tempering is performed, so that a seamless steel tube having superior low temperature toughness can be obtained.

Furthermore, in Patent Document 2, a technique is suggested in which duplex stainless steel tube having superior low temperature toughness is provided by maintaining the content of Cr at 20 to 25% and containing 0.5 to 2.0% of Mn and increasing solubility of N.

The Patent Documents are as follows:

Patent Document 1: Japanese Patent No. 6008062

Patent Document 2: Japanese Patent No. 6303851

However, in the technique disclosed in Patent Document 1, in a case in which large amounts of Al or N are contained, precipitation temperature of AlN is extremely increased, precipitation temperature of AlN is higher than a ferrite single phase temperature, and it is difficult to prevent AlN from being deposited only by controlling the temperature of the hot processing and cooling.

On the other hand, in the technique disclosed in Patent Document 2, Mn is an element that promotes depositing a σ phase, which is a hard, brittle, and harmful intermetallic compound. In particular, in a high corrosion resistant duplex stainless steel which is generally called "super duplex stainless steel" containing in particular large amounts of Cr, Mo and N and having pitting resistance equivalent (PRE) of over 40 calculated by [mass % Cr]+3.3[mass % Mo]+16[mass % N] based on content of Cr, Mo and N, since promotion of precipitation of a σ phase by Mn is noticeable, it is difficult to completely avoid precipitation of the σ phase during practical production, processing, and use, and there is a problem of risk of decrease in toughness or corrosion resistance is not reliably obtained.

SUMMARY OF INVENTION

The present invention was made to solve the above problems, and an object of the present invention is to provide duplex stainless steel having superior low temperature toughness by reducing risk of precipitation of both Al nitride and Cr nitride, which are harmful deposits.

Since Cr and Mo are constituent elements of $[Cr, Mo]_2N$, excess addition thereof promotes precipitation of Cr nitride, and low temperature toughness is decreased. Furthermore, although toughness can be improved by increasing the amount of Ni that is solid-solved in a ferrite phase or an austenite phase, the excess addition of Ni reduces the ferrite phase ratio in steel. Since the solid-solubility limit of N in the ferrite phase is small, N will combine with Cr, which is supersaturated in a ferrite phase, so as to deposit Cr nitride, and therefore, low temperature toughness is decreased. Precipitation of Cr nitride is suppressed since Mn increases solubility of N; however, precipitation of a σ phase is promoted, thereby increasing risk of decreased toughness. Furthermore, Mo, Cr and Ni promote precipitation of Al nitride, thereby also decreasing toughness at low temperatures. However, since elements of Ni, Cr, Mo and N are basic elements which increase corrosion resistance, it is desirable to control the relationships of chemical composition so that these elements are contained in high concentration as possible and at the same time Cr nitride and Al nitride are reduced.

The inventors have researched to solve the above objects. As a result, they found that in order to obtain good low temperature toughness in a structure basically having a chemical composition of Ni: 6 to 7.5 mass %, Cr: 23 to 26 mass %, Mo: 2 to 4.0 mass % and Mn: 0.05 to 0.3 mass % and having a ferrite phase and an austenite phase, it is important to limit the number of particles of Al nitrides and to limit the total length of particles of Cr nitrides. Furthermore, they researched further and also found ranges in which relationships of Al, N, Cr, Mo and Mn are appropriate, and relationships of these elements reducing deposition of Al nitride and Cr nitride. Furthermore, they also specified ranges of contents of other elements that are added in small amounts.

The duplex stainless steel having high corrosion resistance of the present invention was completed based on the above knowledge, and the duplex stainless steel comprises, in mass % (hereinafter "%"), C: 0.001 to 0.030%, Si: 0.05 to 0.5%, S: not more than 0.002%, Ni: 6 to 7.5%, Cr: 23 to 26%, Mo: 2 to 4.0%, N: 0.20 to 0.40%, Al: 0.005 to 0.03%, Mn: 0.05 to 0.3%, B: 0.0001 to 0.0050%, inevitable impurities and Fe being the remainder, wherein an impact value defined in Japanese Industrial Standard Z2242 (JIS Z2242) is not less than 87.5 J/cm$^2$ at −46±2° C.

Furthermore, in the present invention, it is desirable that relationships among Al, N, Mo, Cr, and Ni satisfy the following formula:

$$[\%\ Al]\times[\%\ N]\leq(-22.78\times[\%\ Mo]-5\times[\%\ Cr]-3.611\times[\%\ Ni]+323)\times10^{-4},$$

and relationships among Cr, Mo, N, Ni and Mn satisfy the following formula:

$$([\%\ Cr]+6.5534\times[\%\ Mo])^2\times[\%\ N]\leq-215.6\times[\%\ Ni]+1708.3\times[\%\ Mn]+2150.$$

Furthermore, in the present invention, it is desirable that in a metallic structure, the number particles of Al nitride having lengths not less than 3 μm be not more than 200 particles, and it is desirable that the total length of lines of Cr nitride particles be not more than 2000 μm, each line of Cr nitride particles having a length of not less than 1 μm with a spacing between particles being less than 0.1 μm, at a freely selected site of 1 mm$^2$.

Furthermore, in the present invention, it is desirable that there be contained at least one of 0.01 to 0.70% W and 0.01 to 0.90% Cu.

BRIEF DESCRIPTION OF DRAWINGS

FIG. 1 is a conceptual diagram showing a state in which Cr nitride and Al nitride are deposited.

EMBODIMENTS OF INVENTION

Hereinafter composition components of each element, relationship formulas of Al, N, Cr, Mo, and Mn to restrain deposition of Al nitride and Cr nitride, numbers of Al nitride particles and total length of lines of Cr nitride particles per unit area are explained.

The duplex stainless steel of the present invention contains each element within the ranges explained below, and contains inevitable impurities and Fe being the remainder. The "inevitable impurities" are those that are contained due to various causes during industrial production of the duplex stainless steel and are permitted as long as they do not have adverse effect on the present invention. It should be noted that "%" means "mass %", unless otherwise specified.

C: 0.001 to 0.030%

C is an element that is effective for stabilizing the austenite phase; however, since it also causes deposition of carbide and reduces pitting resistance, it is desirable that the upper limit of the content be 0.030%, and it is particularly desirable that it be not more than 0.025%. On the other hand, from the viewpoint of preventing decrease in strength, it is desirable that the lower limit be not less than 0.001%.

Si: 0.05 to 0.5%

Si is an element that is added as a deoxidizing agent and a desulfurizing agent. In addition, since Si increases flowability of melted alloy, it is an element that improves welding characteristics appropriately. However, excess content of Si promotes deposition of the σ phase. Therefore, it is desirable that the upper limit of Si content be not more than 0.5% from the viewpoint of restraining deposition of intermetallic compound such as the σ phase, and it is particularly desirable that it be not more than 0.35%. It is desirable that the lower limit be not less than 0.05% from the viewpoint of exhibiting effects as a deoxidizing agent. In order to ensure the effects of deoxidizing by Si and to maintain good flowability of melted alloy during welding, it is more desirable that the lower limit be not less than 0.15%.

S: Not More than 0.002%

S is an impurity element that inevitably occurs in steel, deteriorates hot workability of steel, and reduces toughness. Furthermore, it forms sulfide and impairs corrosion resistance because it becomes a starting point of pitting corrosion. Therefore, it is desirable that the S content be as low as possible, and that the upper limit be 0.002%. It is more desirable that it be not more than 0.0015%. However, S is also an element that greatly increases flowability of melted alloy during melting and improves welding characteristics even when contained in small amounts. Therefore, although S is not limited in particular, it is desirable that it be contained at not less than 0.0001% from the viewpoint of good welding characteristics. It should be noted that S is controlled within the range of the present invention by desulfurizing performed by addition of Al and Si.

Mn: 0.01 to 0.30%

Since Mn is an element that generates austenite, it is effective to control the ratio of the austenite phase and the ferrite phase. Furthermore, Mn is an effective element for improving hot workability by fixing S by forming MnS. Furthermore, since Mn increases solubility of N, it is effective to restrain deposition of $Cr_2N$. Therefore, Mn is contained at not less than 0.01%. In order to reliably obtain these effects, it is more desirable it contain not less than 0.1%. However, as mentioned above, excess solid-solution of Mn promotes deposition of the σ phase, and therefore, toughness and corrosion resistance are decreased. Furthermore, in a case in which excess amounts of Mn are contained, MnS is formed even with the presence of small amounts of S, this MnS becomes the origin of pitting corrosion, and therefore, corrosion resistance is deteriorated. Therefore, it is necessary that the upper limit of Mn content amount be not more than 0.3% from the viewpoint of restraining decrease of toughness by restraining deposition of the σ phase, and in order to prevent pitting resistance from being decreased. It is desirable that it be not more than 0.28%, and particularly desirable that it be not more than 0.25%.

Ni: 6 to 7.5%

Ni is an element that generates austenite, and it is necessary to maintain good phase ratio of the ferrite phase and the austenite phase of the duplex stainless steel. Furthermore, Ni is an effective element for corrosion resistance since Ni restrains solution of active state regions and increases solubility of nitrogen. Therefore, it is desirable that the lower limit be not less than 6% in order to maintain balance of the austenite phase and to reliably obtain corrosion resistance. It should be noted that in a case in which excess amounts of Ni are contained, in addition to promotion of deposition of the σ phase and toughness being reduced, the ratio of the austenite phase exceeds 70%, good phase balance as a duplex stainless steel cannot be maintained any longer, and corrosion resistance is deteriorated. In addition, since solid solution limit of N in the ferrite phase is small, it combines with Cr that is supersaturated in the ferrite phase so as to deposit Cr nitride, and low temperature toughness is decreased. Therefore, it is desirable that the upper limit of Ni content amount be 7.5%. It is more desirable that it be not more than 7%.

Cr: 23 to 26%

Cr is an element that generates ferrite, and is a necessary element to improve pitting resistance. However, excess content of Cr promotes deposition of Cr nitride and reduces low temperature toughness. Furthermore, Cr promotes deposition of the σ phase, and this also deteriorates toughness. Therefore, it is desirable that the upper limit of Cr content amount be 26%, and it is particularly desirable that it be not more than 25.8% from the viewpoint of preventing excessive increase of the ferrite phase and maintaining duplex structure. On the other hand, it is desirable that the lower limit of the Cr content amount be not less than 23% from the viewpoint of reliably obtaining pitting resistance. It is more desirable that the range of Cr content amount be 24 to 25.8% from the viewpoint of maintaining corrosion resistance by containing Cr and maintaining good balance of the ferrite phase and the austenite phase, and it is particularly desirable that it be in a range of 25.0 to 25.8%.

Mo: 2 to 4.0%

Mo is an element that improves pitting resistance in a manner similar to Cr, N, and the like. It should be noted that in a case in which excess amounts of Mo are contained, deposition of nitride as $[Cr, Mo]_2N$ is promoted. Furthermore, deposition of the σ-phase is also promoted and thereby deteriorates toughness. Therefore, it is desirable that the upper limit of Mo content amount be 4.0%, and that the lower limit thereof be not less than 3% from the viewpoint of obtaining necessary corrosion resistance. It is more desirable that the range of Mo be 3.2 to 3.8%.

N: 0.20 to 0.40%

N is an element that strongly generates austenite, and it is a necessary element to balance the ferrite phase and the austenite phase appropriately. Furthermore, it has an effect of greatly improving pitting resistance. On the other hand, in a case in which the N content amount is excessive, Al nitride and Cr nitride are generated and thereby deteriorate low temperature toughness and corrosion resistance and the like. Furthermore, welding property is deteriorated such that a blowhole may easily form during welding. Therefore, it is desirable that the lower limit of N be not less than 0.2%, and it is more desirable that it be not less than 0.22% from the viewpoint of reliably obtaining corrosion resistance. Furthermore, it is desirable that the upper limit be not more than 0.40% from the viewpoint of restraining generation of nitride.

Al: 0.005 to 0.03%

Al is a component that is added as a deoxidizing agent and desulfurizing agent that is similar to Si, and it is an important element to stabilize yield of B. However, in a case in which an excessive amount of Al is contained, AlN or the like is deposited, thereby deteriorating low temperature toughness. Furthermore, the N content amount is insufficient in the ferrite phase and the austenite phase in the neighborhood of the nitride, thereby reducing corrosion resistance. Therefore, it is desirable that the upper limit of the content amount of Al be not more than 0.03% from the viewpoint of restraining deposition of Al nitride and preventing decrease in toughness, and desirable that the lower limit be not less than 0.005% from the viewpoint of exhibiting action as a deoxidizing agent.

B: 0.0001 to 0.005%

B strongly restrains deposition of the σ phase and effectively acts for resistance to embrittlement. Furthermore, B has an effect in which B segregates at a grain boundary earlier than S, deterioration of strength of grain boundary due to segregation of S is restrained, and thereby hot workability is improved. Therefore, it is desirable that not less than 0.0001% B be contained. On the other hand, excessive amounts of B content causes deposition of boride and reduces toughness. In addition, since B increases hot cracking susceptibility during welding, it is desirable that the upper limit of B be 0.005%.

$$[\%\ Al]\times[\%\ N]\leq(-22.78\times[\%\ Mo]-5\times[\%\ Cr]-3.611\times[\%\ Ni]+323)\times10^{-4}$$

Each element mentioned above is contained in its allowable range, and each element satisfies the above relationship shown concerning Al nitride deposition. As a result, deposition of Al nitride is restrained, and the number of Al nitride particles per unit area mentioned below is satisfied.

$$([\%\ Cr]+6.5534\times[\%\ Mo])^2\times[\%\ N]\leq-215.6\times[\%\ Ni]+1708.3\times[\%\ Mn]+2150$$

Similarly, each element mentioned above is contained in its allowable range, and each element satisfies the above relationship shown concerning Cr nitride deposition. As a result, deposition of Cr nitride is restrained, and total length of Cr nitride particles per unit area, mentioned below is satisfied. The number of Al nitride particles having lengths not less than 3 μm in a site of 1 $mm^2$ is not more than 200 particles Since Al nitride grows in short columnar shapes or acicular shapes, effects on toughness primarily depend on the size in the longitudinal direction rather than the size in the diameter. In a structure of duplex stainless steel, low temperature toughness is decreased in a case in which a large number of Al nitride particles of large size having lengths not less than 3 μm are deposited, and in particular, low temperature toughness is obviously decreased in a case in which the number of Al nitrides particles present in a field of view of 1 $mm^2$ is over 200 particles. Therefore, the number of Al nitride particles having lengths not less than 3 μm in a field of view of 1 $mm^2$ is set to be not more than 200 particles. It is desirable that the number be not more than 150, and it is more desirable that it be not more than 100. The total length of lines of Cr nitride particles is not more than 2000 μm, each line of Cr nitride particles having a length not less than 1 μm, with a spacing between particles of less than 0.1 μm, in a site of 1 $mm^2$.

Since Cr nitride is deposited preferentially at a crystal grain boundary, total length of lines of Cr nitride particles at the grain boundary will be a dominant factor. Cr nitride particles are very fine at the start, but these nitrides grow, combine with each other, and thereby form a continuous body. If the fine Cr nitrides are sufficiently apart from each other, toughness is not much affected. However, in a case in which they are continuous along a length not less than 1 μm in a condition in which each narrow spacing between nitrides is less than 0.1 μm, toughness is reduced. Therefore, the total length of lines of Cr nitride particles, each line of particles having a length of not less than 1 μm and having a spacing between particles of less than 0.1 μm, is set to be not more than 2000 μm in a site of 1 $mm^2$. It is desirable that it not be more than 1500 μm, and more desirable that it not be more than 1000 μm.

By restraining the number of particles of AlN and the total length of $Cr_2N$ per unit area, the steel will exhibit superior low temperature toughness with a JIS Z2242 impact value of not less than 87.5 J/cm$^2$ at −46° C.

By satisfying the relationship formulas limiting Al nitride and Cr nitride at the same time, the abovementioned number of Al nitride particles and total length of Cr nitride particles are limited to within the permitted ranges.

Although it is not limited in particular in the present invention, it is desirable that a method for duplex stainless steel of the present invention be as follows. That is, first, raw material such as iron scrap, stainless steel scrap, ferrochrome, ferronickel, pure nickel, metallic chromium and the like are melted in an electric furnace of 60 t. After that, during AOD or VOD processing, oxygen and argon are blown therein so as to perform decarburizing and refining After that, calcined lime, fluorite, Al and Si are added so as to perform desulfurizing and deoxidizing Slag composition at this time is of the $CaO—Al_2O_3—SiO_2—MgO—F$ type. In this process, it is desirable that $CaO/Al_2O_3 \geq 2$ and $CaO/SiO_2 \geq 3$ be satisfied in order to effectively promote desulfurizing. It is desirable that the lining of the AOD or VOD refining furnace be magnesite-chrome and dolomite. In this way, after AOD refining, component control and temperature control are performed in an LF process, and an ingot casting is performed by a continuous casting machine to produce slab. After that, hot rolling and cold rolling are performed so as to obtain a thick or thin plate.

It should be noted that in the continuous casting machine, an electromagnetic stirring machine is set at a location 3 in from the meniscus, which is the level of the surface of the melted steel in a mold. By electromagnetic stirring, melted steel, which has not yet solidified inside a solidifying shell, is stirred, and therefore, it is possible to homogenize elements which are ejected to a front surface when forming dendritic crystals during solidifying. In particular, Al, N, Cr, Mo and Ni are homogenized by this stirring, and there is an effect of restraining formation of Al nitride and Cr nitride.

Examples

Hereinafter the present invention is further explained in detail by way of Examples. It should be noted that the present invention is not limited to these Examples as long as the Examples are not outside of the ranges. First, raw material such as iron scrap, stainless steel scrap, ferrochrome, ferronickel, pure nickel and metallic chromium was melted in an electric furnace of 60 t. After that, in the AOD process, oxygen and argon were blown so as to perform decarburizing and refining. After that, calcined lime, fluorite, Al, and Si were added to perform desulfurizing and deoxidizing. During this time, slag composition was of the $CaO—Al_2O_3—SiO_2—MgO—F$ type. After refining, LF processing was performed, ingot casting was performed by a continuous casting machine, and slabs of Examples and slabs of Comparative Examples (Samples 1 to 22), having chemical compositions as shown in Table 1, were obtained. In the continuous casting machine, electromagnetic stirring operation in which melted steel not yet solidified inside a solidifying shell was stirred so as to be homogenized. The size of the slab was width 1200 mm×thickness 200 mm×length 7000 mm.

In these samples, chemical components other than C, S, and N were analyzed by fluorescent X-ray analysis. In addition, N was analyzed by an inert gas-impulse heating melting method, and C and S were analyzed by combustion in oxygen gas flow-IR spectrometry. In the Table, underlining indicates amounts outside the desirable range.

TABLE 1

| Section | Sample No. | Main elements/Fluctuation component (proven value) | | | | | | | | | | | |
|---|---|---|---|---|---|---|---|---|---|---|---|---|---|
| | | C | Si | Mn | S | Ni | Cr | Mo | N | W | Cu | Al | B |
| Examples | 1 | 0.015 | 0.19 | 0.23 | 0.0002 | 6.39 | 25.06 | 3.69 | 0.282 | 0.07 | — | 0.025 | 0.0024 |
| | 2 | 0.016 | 0.30 | 0.21 | 0.0002 | 6.00 | 25.59 | 3.51 | 0.292 | — | 0.23 | 0.027 | 0.0045 |
| | 3 | 0.015 | 0.19 | 0.28 | 0.0000 | 6.42 | 25.89 | 3.52 | 0.312 | — | — | 0.025 | 0.0033 |
| | 4 | 0.015 | 0.19 | 0.05 | 0.0004 | 6.45 | 25.92 | 3.51 | 0.298 | — | — | 0.025 | 0.0003 |
| | 5 | 0.016 | 0.16 | 0.11 | 0.0003 | 6.41 | 25.06 | 3.46 | 0.301 | 0.68 | 0.83 | 0.029 | 0.0015 |
| | 6 | 0.019 | 0.22 | 0.15 | 0.0002 | 6.46 | 24.59 | 3.38 | 0.298 | 0.62 | 0.79 | 0.023 | 0.0008 |
| | 7 | 0.015 | 0.19 | 0.12 | 0.0004 | 5.96 | 25.83 | 3.75 | 0.328 | — | — | 0.020 | 0.0010 |
| | 8 | 0.017 | 0.20 | 0.29 | 0.0002 | 6.40 | 25.72 | 3.55 | 0.300 | — | 0.08 | 0.025 | 0.0015 |
| | 9 | 0.015 | 0.25 | 0.30 | 0.0002 | 6.43 | 25.60 | 3.52 | 0.310 | — | — | 0.015 | 0.0015 |
| | 10 | 0.017 | 0.21 | 0.30 | 0.0004 | 6.48 | 25.77 | 3.49 | 0.375 | 0.52 | 0.55 | 0.027 | 0.0001 |
| | 11 | 0.017 | 0.16 | 0.20 | 0.0004 | 7.42 | 25.90 | 3.91 | 0.362 | — | — | 0.012 | 0.0020 |
| | 12 | 0.016 | 0.22 | 0.08 | 0.0003 | 7.25 | 23.28 | 3.45 | 0.395 | — | — | 0.011 | 0.0024 |
| | 13 | 0.015 | 0.12 | 0.05 | 0.0006 | 6.48 | 25.74 | 3.55 | 0.350 | — | — | 0.025 | 0.0048 |
| Comparative Examples | 14 | 0.017 | 0.19 | 0.28 | 0.0004 | 6.39 | 25.77 | 3.55 | 0.291 | — | — | 0.039 | 0.0007 |
| | 15 | 0.017 | 0.21 | 0.22 | 0.0004 | 6.39 | 25.78 | 3.55 | 0.295 | 0.68 | 0.66 | 0.034 | 0.0007 |
| | 16 | 0.016 | 0.19 | 0.15 | 0.0003 | 6.37 | 25.60 | 3.65 | 0.304 | 0.51 | 0.55 | 0.036 | 0.0048 |
| | 17 | 0.016 | 0.20 | 0.11 | 0.0004 | 7.79 | 25.90 | 3.49 | 0.302 | 0.08 | 0.08 | 0.032 | 0.0032 |
| | 18 | 0.016 | 0.11 | 0.02 | 0.0003 | 6.42 | 25.87 | 4.30 | 0.309 | — | — | 0.028 | 0.0039 |
| | 19 | 0.015 | 0.19 | 0.03 | 0.0004 | 7.50 | 25.77 | 3.55 | 0.291 | — | — | 0.100 | 0.0010 |
| | 20 | 0.016 | 0.24 | 0.10 | 0.0007 | 6.39 | 26.60 | 3.54 | 0.318 | — | — | 0.028 | 0.0010 |
| | 21 | 0.015 | 0.19 | 0.52 | 0.0005 | 6.40 | 25.06 | 3.49 | 0.309 | — | — | 0.031 | 0.0046 |
| | 22 | 0.016 | 0.22 | 1.97 | 0.0007 | 6.52 | 25.76 | 3.50 | 0.412 | — | — | 0.024 | 0.0000 |

After that, according to a generally used method, hot rolling was performed so as to obtain a hot rolled steel plate having a thickness of 5.5 to 60 mm Evaluation of low temperature toughness was made by performing predetermined solid-solution heat treatment of this hot rolled steel plate, and by performing Charpy impact test at −46° C. thereafter. The predetermined solid-solution heat treatment herein is a very important treatment in production of duplex stainless steel. That is, it is performed for the purpose of controlling the phase ratio of ferrite (σ phase) and austenite (γ phase) to be a ratio yielding superior properties. Practically, it is performed by performing heat treatment for 70 minutes at 1080° C. and then cooling by water so as to fix the phase ratio, and the cooling rate was not less than 3° C./s. In this Embodiment, cooling was performed by water cooling, and the cooling rate was 4.5° C./s. Next, by observation of the structure of this hot rolled steel plate, deposition amounts of Al nitride and Cr nitride were evaluated. These methods are explained below.

Low Temperature Toughness Test Method:

From the hot rolled steel plate obtained as above having a plate thickness of 60 mm, on which solid-solution heat treatment and water cooling were performed, test pieces of full size having a width of 10 mm and a V notch of 2 mm were produced, so that the length of the test piece was parallel to the rolling direction of the hot rolled steel plate. Impact value at −46±2° C. was evaluated according to JIS Z2242 (2006). For temperature control, the entire test piece was immersed in a mixture of ethanol and dry ice until the piece reached the predetermined temperature; it was held for not less than 5 minutes, and it was used in the test. In the evaluation, a case in which impact value was not less than 87.5 J/cm$^2$ was evaluated as good "O", and a case in which the impact value was less than 87.5 J/cm$^2$ was evaluated as inferior "X" in Table 2.

Evaluation Method of Metallic Structure:

With respect to the hot rolled steel plate obtained as above, to which solid-solution heat treatment and water cooling were performed, electrolytic polishing was performed on a cross section perpendicular to the rolling direction, and observation of structure and measurement of deposited material of the sample were performed using a field-emission type scanning electron microscope. Al nitride was evaluated at 500× magnification of observation, and Cr nitride was evaluated at 5000× magnification of observation. FIG. 1 shows a conceptual diagram of an image during observation of the structure of a sample. A thin line between the γ phase (reference numeral 1) and α phase (reference numeral 2) indicates the grain boundary (reference numeral 3), a black point indicates a deposited Al nitride (reference numeral 4), and a thick line on the grain boundary means Cr nitride (reference numeral 5).

In Table 2, a case in which the number particles of Al nitride having lengths not less than 3 μm was more than 200 particles, and the total length of lines of Cr nitride particles, each line of particles not less than 1 μm, was more than 2000 μm in a sample 1 mm$^2$ was evaluated as "X" being inferior, a case in which the number of particles of Al nitride having lengths of not less than 3 μm was not more than 200 particles, and the total length of lines of Cr nitride particles, each line of particles having a length of not less than 1 μm, which was not more than 2000 μm was evaluated as "O" being good, and a case in which one of the number of particles and the total length was good and the other was bad was rated "Δ".

In Table 2, each decision by $[\%\ Al]\times[\%\ N]\leq(-22.78\times[\%\ Mo]-5\times[\%\ Cr]-3.611\times[\%\ Ni]+323)\times10^{-4}$ being relationship formulas restraining Al nitride deposition and $([\%\ Cr]+6.5534\times[\%\ Mo])^2\times[\%\ N]\leq-215.6\times[\%\ Ni]+1708.3\times[\%\ Mn]+2150$ being relationship formulas restraining Cr nitride deposition of the present invention is also shown, and a case in which the relationship was satisfied was evaluated as "O" and a case in which the relationship was not satisfied was evaluated as "X" in columns "Al nitride relationship formula" and "Cr nitride relationship formula", respectively. Furthermore, a case in which both relationships were satisfied was evaluated as "O" and a case in which one of the relationships was satisfied was evaluated as "X" in the column "nitride decision equation".

TABLE 2

| Section | Sample No. | Low temperature toughness: Impact value | Low temperature toughness: Decision | Al nitrides relationship formula: Left member | Al nitrides relationship formula: Right member | Al nitrides relationship formula: Decision | Cr nitrides relationship formula: Left member | Cr nitrides relationship formula: Right member | Cr nitrides relationship formula: Decision | Nitrides decision equation | Number of Al nitrides | Length of Cr nitrides | Decision of number and length of nitrides |
|---|---|---|---|---|---|---|---|---|---|---|---|---|---|
| Examples | 1 | 350.0 | ○ | 0.0071 | 0.0091 | ○ | 683.8 | 1165.2 | ○ | ○ | 29 | 302 | ○ |
| | 2 | 306.3 | ○ | 0.0079 | 0.0093 | ○ | 689.5 | 1215.1 | ○ | ○ | 53 | 284 | ○ |
| | 3 | 287.5 | ○ | 0.0078 | 0.0090 | ○ | 747.8 | 1244.2 | ○ | ○ | 66 | 452 | ○ |
| | 4 | 342.5 | ○ | 0.0075 | 0.0090 | ○ | 713.2 | 844.8 | ○ | ○ | 37 | 550 | ○ |
| | 5 | 195.0 | ○ | 0.0087 | 0.0096 | ○ | 685.9 | 955.9 | ○ | ○ | 118 | 920 | ○ |
| | 6 | 355.0 | ○ | 0.0069 | 0.0100 | ○ | 651.0 | 1013.5 | ○ | ○ | 15 | 570 | ○ |
| | 7 | 256.3 | ○ | 0.0066 | 0.0087 | ○ | 833.3 | 1070.0 | ○ | ○ | 60 | 1150 | ○ |
| | 8 | 348.8 | ○ | 0.0075 | 0.0090 | ○ | 719.8 | 1265.6 | ○ | ○ | 35 | 52 | ○ |
| | 9 | 356.3 | ○ | 0.0047 | 0.0092 | ○ | 734.3 | 1276.2 | ○ | ○ | 0 | 137 | ○ |
| | 10 | 88.6 | ○ | 0.0101 | 0.0091 | x | 887.2 | 1265.4 | ○ | x | 201 | 1830 | Δ |
| | 11 | 89.2 | ○ | 0.0043 | 0.0078 | ○ | 961.0 | 891.9 | x | x | 100 | 2010 | Δ |
| | 12 | 90.3 | ○ | 0.0043 | 0.0103 | ○ | 824.7 | 723.6 | x | x | 82 | 2005 | Δ |
| | 13 | 87.8 | ○ | 0.0088 | 0.0090 | ○ | 840.5 | 838.3 | x | x | 190 | 2020 | Δ |
| Comparative Examples | 14 | 56.3 | x | 0.0113 | 0.0090 | x | 699.7 | 1250.6 | ○ | x | 347 | 220 | Δ |
| | 15 | 62.0 | x | 0.0100 | 0.0090 | x | 709.6 | 1148.1 | ○ | x | 267 | 162 | Δ |
| | 16 | 65.0 | x | 0.0109 | 0.0089 | x | 745.5 | 1032.9 | ○ | x | 326 | 336 | Δ |
| | 17 | 50.0 | x | 0.0097 | 0.0086 | x | 718.4 | 658.4 | x | x | 301 | 7654 | x |
| | 18 | 47.5 | x | 0.0087 | 0.0073 | x | 902.7 | 800.0 | x | x | 307 | 7972 | x |
| | 19 | 38.8 | x | 0.0291 | 0.0086 | x | 699.7 | 584.2 | x | x | 1328 | 8299 | x |
| | 20 | 68.5 | x | 0.0089 | 0.0086 | x | 788.6 | 943.1 | ○ | x | 228 | 1723 | Δ |
| | 21 | 62.0 | x | 0.0096 | 0.0095 | x | 709.9 | 1658.5 | ○ | x | 220 | 223 | Δ |
| | 22 | 58.9 | x | 0.0099 | 0.0091 | x | 977.0 | 4109.6 | ○ | x | 235 | 0 | Δ |

As shown in Table 2, in samples Nos. 1 to 13, each component satisfies the range of the present invention, and impact value at −46±2° C. was not less than 87.5 J/cm$^2$, showing good low temperature toughness. Among these, in the sample No. 10 in which the relationship formula of restraining Al nitride deposition was not satisfied, the number of Al nitride deposited particles having lengths of not less than 3 μm per sample 1 mm$^2$ was more than 200 particles. In addition, in the samples Nos. 11 to 13 in which the relationship formula of restraining Cr nitride deposition was not satisfied, the total length of lines of Cr nitride particles, each line of particles having a length of not less than 1 μm per sample 1 $mm^2$, was more than 2000 μm. Therefore, although evaluation of the impact value was "0", they were relatively low values compared to samples Nos. 1 to 9.

On the other hand, in samples Nos. 14 to 22 that were out of the component ranges of the present invention, the impact value was less than 80.0 $J/cm^2$ in all cases. Since these samples did not satisfy the component ranges of the present invention, and in addition, they did not satisfy one or both of the relationship formulas of Al nitride and Cr nitride, Al nitride or Cr nitride were deposited more than the range of the present invention.

Comparative Examples are explained in detail below. In samples Nos. 14 to 16, since the Al content was above the upper limit, they did not satisfy the Al nitride relationship formula, large amounts of Al nitride were deposited, and low temperature toughness was deteriorated.

In sample No. 17, although the Al content was above the upper limit, the Ni content was also above the upper limit, and effects were greater, it did not satisfy both of the Al nitride relationship formula and the Cr nitride relationship formula, large amounts of Al nitride and Cr nitride were deposited, and low temperature toughness was deteriorated.

In the sample No. 18, since the Mn content was below the lower limit and the Mo content was above the upper limit, solubility of N was reduced, deposition of nitride was promoted, both the Al nitride relationship formula and the Cr nitride relationship formula were not satisfied, large amounts of Al nitride and Cr nitride were deposited, and low temperature toughness was deteriorated.

In sample No. 19, since the Al content was above the upper limit, the Al nitride relationship formula was not satisfied, and a large amount of Al nitride was deposited, and since the Mn content was below the lower limit, the Cr nitride relationship formula was not satisfied, and a large amount of Cr nitride was deposited, and low temperature toughness was deteriorated.

In sample No. 20, since the Cr content was above the upper limit, although the Cr nitride relationship formula was satisfied, Al nitride relationship formula was not satisfied and a large amount of Al nitride was deposited, and low temperature toughness was deteriorated.

In sample No. 21, since the Mn content was above the upper limit, solubility of N was increased, although under conditions in which it was difficult to deposit nitride, the Al content was above the upper limit, the Al nitride relationship formula was not satisfied, a large amount of Al nitride was deposited, and low temperature toughness was deteriorated.

In sample No. 22, since the Mn content was above the upper limit, the solubility of N was increased, although under conditions in which it was difficult to deposit nitride, the N content was above the upper limit, the Al nitride relationship formula was not satisfied, a large amount of Al nitride was deposited, and low temperature toughness was deteriorated.

The duplex stainless steel of the present invention can exhibit superior toughness even under low temperature environments of −46±2° C. Furthermore, since it has superior corrosion resistance, it is desirable as an umbilical tube and a welding tube for heat exchangers under severe corrosive environments containing sulfide, and for structural members of pipelines, in petroleum chemistry, and for oil wells.

EXPLANATION OF REFERENCE NUMERALS

1: γ phase
2: α phase
3: grain boundary
4: Al nitride
5: Cr nitride

What is claimed is:

1. A duplex stainless steel comprising:

in mass %, C: 0.001 to 0.030%, Si: 0.05 to 0.5%, S: not more than 0.002%, Ni: 6.39 to 7%, Cr: 23 to 26%, Mo: 2 to 4.0%, N: 0.20 to 0.40%, Al: 0.005 to 0.03%, Mn: 0.05 to 0.3%, B: 0.0001 to 0.0050%, Cu: 0.01 to 0.90%, inevitable impurities and Fe being remainder, wherein an impact value defined in Japanese Industrial Standards Z2242 is controlled to be not less than 87.5 $J/cm^2$ at −46±2° C.

2. The duplex stainless steel according to claim 1, wherein relationships among Al, N, Mo, Cr, and Ni satisfy the following formula:

$$[\%\ Al]\times[\%\ N]\leq(-22.78\times[\%\ Mo]-5\times[\%\ Cr]-3.611\times[\%\ Ni]+323)\times10^4,\ \text{and}$$

relationships among Cr, Mo, N, Ni, and Mn satisfy the following formula:

$$([\%\ Cr]+6.5534\times[\%\ Mo])^2\times[\%\ N]\leq-215.6\times[\%\ Ni]+1708.3\times[\%\ Mn]+2150.$$

3. The duplex stainless steel according to claim 1, wherein in a metallic structure, a number of particles of Al nitride having lengths not less than 3 μm is not more than 200 particles, and a total length of lines of Cr nitride particles, each line of particles not less than 1 μm in length and having a spacing between particles of less than 0.1 μm, is not more than 2000 μm, in a freely selected site of 1 $mm^2$.

4. The duplex stainless steel according to claim 2, wherein in a metallic structure, a number of particles of Al nitride having lengths not less than 3 μm is not more than 200 particles, and a total length of lines of Cr nitride particles, each line of particles not less than 1 μm in length and having a spacing between particles of less than 0.1 μm, is not more than 2000 μm, in a freely selected site of 1 $mm^2$.

5. The duplex stainless steel according to claim 1, wherein 0.01 to 0.70% of W is contained.

6. The duplex stainless steel according to claim 2, wherein 0.01 to 0.70% of W is contained.

7. The duplex stainless steel according to claim 3, wherein 0.01 to 0.70% of W is contained.

8. The duplex stainless steel according to claim 4, wherein 0.01 to 0.70% of W is contained.

9. The duplex stainless steel according to claim 3, wherein the number of particles of Al nitride having lengths not less than 3 μm is not more than 150 particles.

10. The duplex stainless steel according to claim 3, wherein the number of particles of Al nitride having lengths not less than 3 μm is not more than 100 particles.

11. The duplex stainless steel according to claim 3, wherein the total length of lines of Cr nitride particles, each line of particles not less than 1 μm in length and having a spacing between particles of less than 0.1 μm, is not more than 1500 μm, in a freely selected site of 1 $mm^2$.

12. The duplex stainless steel according to claim 3, wherein the total length of lines of Cr nitride particles, each line of particles not less than 1 μm in length and having a spacing between particles of less than 0.1 μm, is not more than 1000 μm, in a freely selected site of 1 $mm^2$.

13. The duplex stainless steel according to claim 1, wherein 0.08 to 0.23% of Cu is contained.

14. The duplex stainless steel according to claim 2, wherein 0.08 to 0.23% of Cu is contained.

15. The duplex stainless steel according to claim 3, wherein 0.08 to 0.23% of Cu is contained.

16. The duplex stainless steel according to claim 4, wherein 0.08 to 0.23% of Cu is contained.

* * * * *